US005156127A

United States Patent [19]

Ghaem

[11] Patent Number: 5,156,127

[45] Date of Patent: Oct. 20, 1992

[54] METHOD FOR OPTIMIZING PLUG FIRING TIME AND PROVIDING DIAGNOSTIC CAPABILITY IN AN AUTOMOTIVE IGNITION SYSTEM

[75] Inventor: Sanjar Ghaem, Palatine, Ill.

[73] Assignee: Motorola, Inc., Schaumburg, Ill.

[21] Appl. No.: 636,350

[22] Filed: Dec. 31, 1990

[51] Int. Cl.[5] ..... F02P 17/00

[52] U.S. Cl. ..... 123/426; 123/630; 324/391; 324/399

[58] Field of Search ..... 123/426, 644, 630; 324/391, 399

[56] References Cited

U.S. PATENT DOCUMENTS

| | | | |
|---|---|---|---|
| 3,551,800 | 12/1970 | Widmer | 324/391 |
| 3,603,872 | 9/1971 | Pelta | 324/16 |
| 4,018,202 | 4/1977 | Gartner | 123/609 |
| 4,381,748 | 5/1983 | Eckert et al. | 123/414 |
| 4,438,751 | 3/1984 | Iwasaki | 123/606 |
| 4,479,479 | 10/1984 | Dömland et al. | 123/630 |
| 4,549,513 | 10/1985 | Douaud et al. | 123/426 |
| 4,913,123 | 4/1990 | DeBiasi et al. | 123/426 |

FOREIGN PATENT DOCUMENTS

| | | | |
|---|---|---|---|
| 2116329 | 9/1983 | United Kingdom | 123/644 |

*Primary Examiner*—Andrew M. Dolinar
*Attorney, Agent, or Firm*—John H. Moore

[57] ABSTRACT

The firing time of a spark plug (22) is optimized by measuring its actual firing time (as by detecting the rise of current in the secondary winding (44) of an ignition coil (24)), comparing the actual firing time to the desired firing time, and advancing or retarding the turn-off time of current in the ignition coil's primary winding (42) to reduce any measured difference between the measured actual firing time and the desired firing time. The measurements can also be used to provide diagnostic information concerning the ignition system.

2 Claims, 4 Drawing Sheets

METHOD FOR OPTIMIZING PLUG FIRING TIME AND PROVIDING DIAGNOSTIC CAPABILITY IN AN AUTOMOTIVE IGNITION SYSTEM

FIELD OF THE INVENTION

This invention is directed to automotive ignition systems, and particularly to such systems that include electronic control of spark timing.

BACKGROUND OF THE INVENTION

A conventional automotive ignition system is shown in FIG. 1. In this system, a microprocessor-based ECU (Electronic Control Unit) 10 receives inputs from a sensor 12, and typically from one or more additional sensors within an automobile, for generating a spark command signal which is calculated to cause a spark to fire at a desired time. An output driver 14 responds to the spark command signal by energizing a high voltage system 16 (typically including an ignition coil) which causes one or more selected spark plugs to fire.

A problem with this conventional system arises as the high voltage system and/or the spark plugs change their characteristics, either because of aging or inherent defects. If, for example, the spark plugs become partially fouled, they probably will not fire at the proper time. A late or an early firing of one or more of the spark plugs can result in degraded combustion, excessive pollutants in the exhaust, and generally degraded performance.

OBJECTS OF THE INVENTION

It is a general object of the invention to provide improved method for overcoming the above-noted deficiencies with conventional ignition systems.

It is a more specific object of the invention to provide an improved technique for causing the spark plugs to fire at the proper time, irrespective of spark plug fouling and other such factors which can give rise to improper spark firing.

It is a further object of the invention to provide such an improved technique so that the ignition system has diagnostic capability for identifying various ignition problems.

DESCRIPTION OF THE PREFERRED EMBODIMENTS

Figure 1:
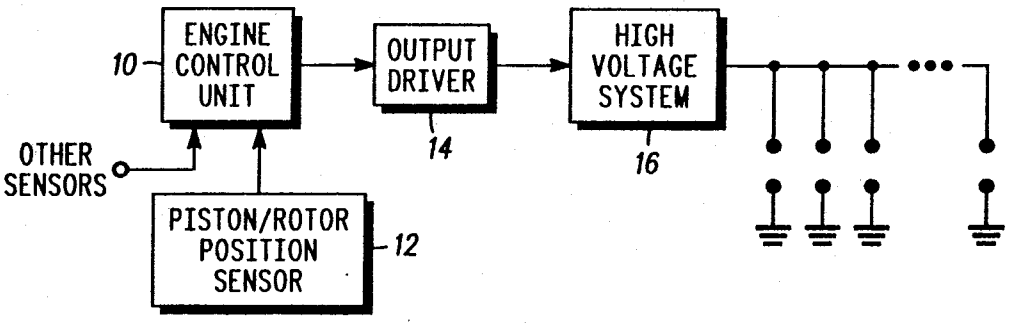
FIG. 1, discussed above, is a block diagram of a conventional ignition system.
Figure 2:
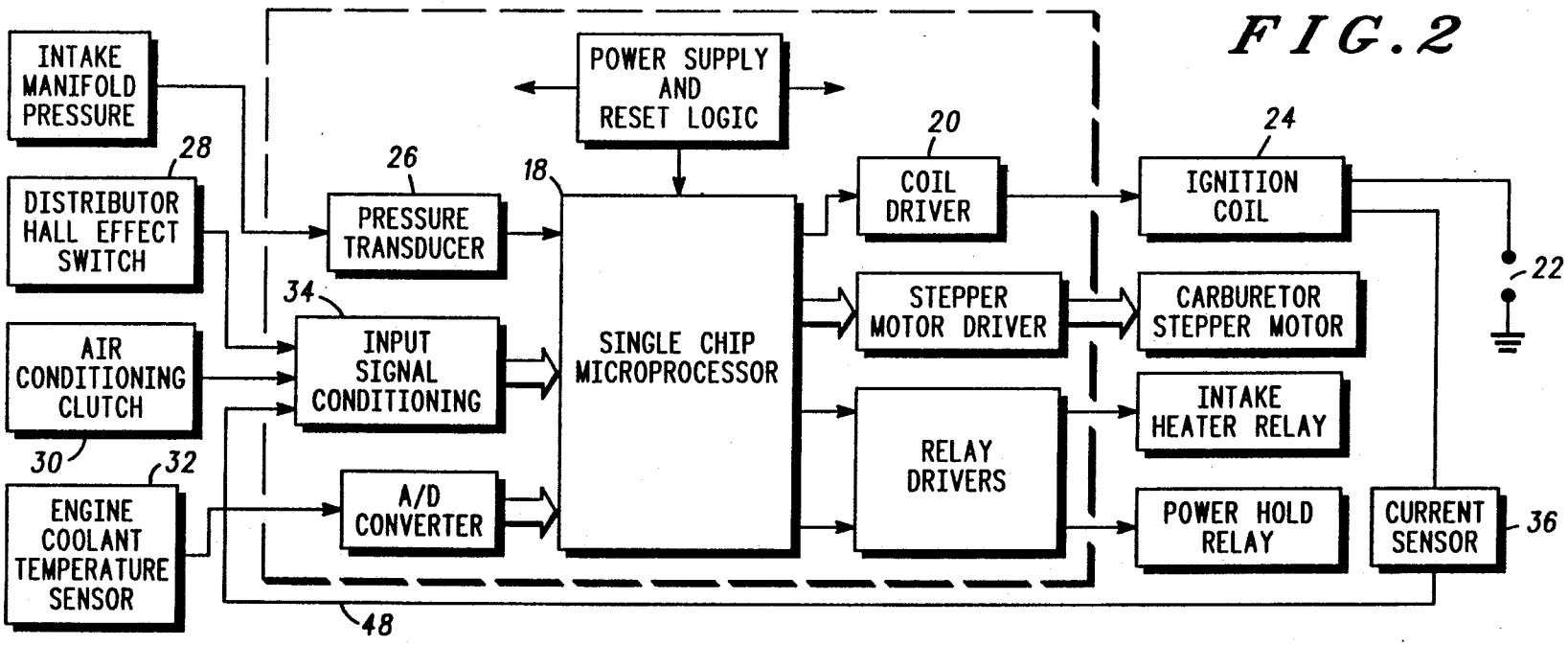
FIG. 2 is a block diagram of an automotive engine control system that incorporates the invention.

Referring to FIG. 2, an exemplary automotive engine control system is shown. Most of the illustrated system is conventional, but it has been modified as will be described to implement the present invention. The heart of the illustrated system is a microprocessor 18 which may be, for example, a 68HC05 microprocessor made by Motorola, Inc. This microprocessor is programmed to energize a coil driver 20 for firing a spark plug 22 via an ignition coil 24. (In practice, more than one spark plug will usually be fired under control of the microprocessor, but only one plug has been shown.)

The time at which the spark plug is commanded to fire depends on factors such as engine RPM, manifold pressure, temperature, etc. All this information is provided to the microprocessor from various sensors and/or switches 26, 28, 30, 32 (others are not shown), the outputs of which may first be processed by conventional input signal conditioning circuitry 34 before being applied as inputs to the microprocessor 18.

As previously discussed, the firing time of a spark plug may be improper because of an improper gap between the plug's electrodes, poor insulation on the wire that couples high voltage pulses from the ignition coil to the spark plug, and various other factors associated with the ignition system. As a result, the gas between the plug's electrodes may not ionize at a precise, preferred position of the associated piston.

To cause such ionization to occur at the preferred position of a piston within its cylinder, I measure the actual firing time of the spark plug (i.e., the time when the gas between the plug's electrodes first ionizes), compare the measured firing time to the desired firing time, and adjust the time at which the magnetic field in the ignition coil collapses so as to reduce any difference between the measured firing time and the desired firing time. As this technique provides diagnostic capabilities, I also preferably signify the existence of a fault condition in response to the existence of a large difference between the actual firing time and the desired firing time.

In the preferred embodiment, an average actual firing time is calculated so as to ignore unusual firing times that are not likely to be repeated. The average actual firing time is then compared to the desired firing time, after which the timing of the spark command signal is either retarded or advanced, as needed, to reduce any difference between the desired firing time and the average actual firing time.

In FIG. 2, a current sensor 36 is coupled to the ignition coil 24 in order to measure the actual firing time of the spark plug. A signal representing the measured actual firing time may, if necessary, be processed by the input signal conditioning circuitry 34 prior to being supplied to the microprocessor 18. The latter device is programmed (as described below) to change the firing time of the spark plug so as to reduce the difference between the measured firing time and the desired firing time, and to signify when a fault condition exists.

Figure 3:
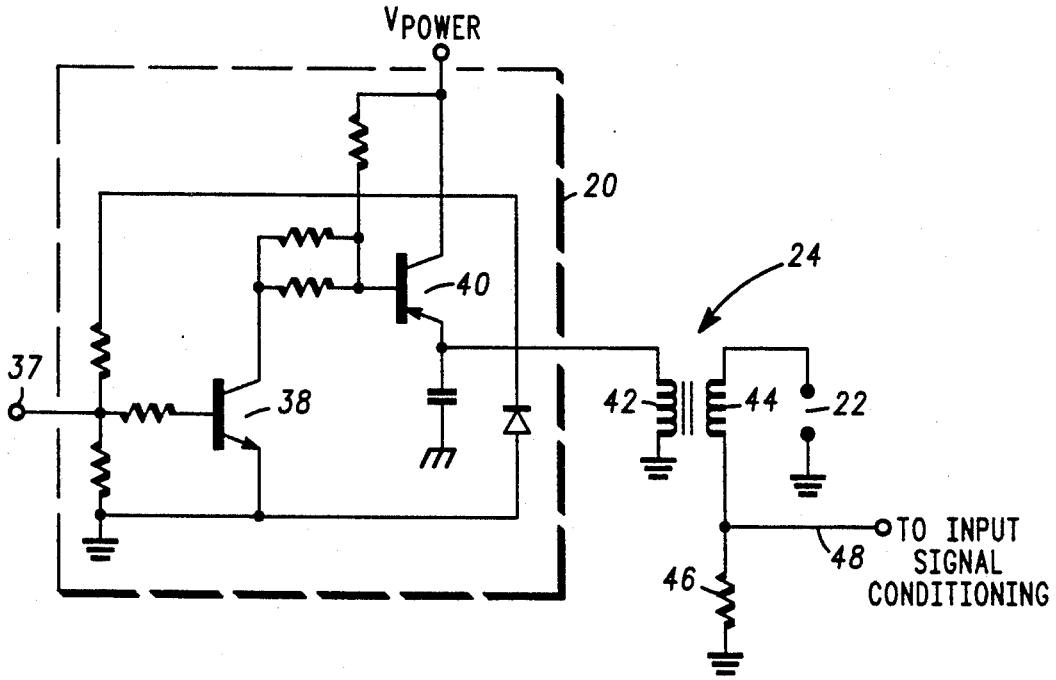
FIG. 3 is a detailed circuit diagram of the coil driver shown in FIG. 2.

Before discussing how the microprocessor is preferably programmed to implement the invention, reference is made to FIG. 3 to illustrate preferred circuitry for measuring the actual firing time of a spark plug. As shown, the coil driver 20 (which is not part of the present invention) includes an input terminal 37 which receives spark command signals from the microprocessor 18. These command signals are processed by transistors 38 and 40, and the illustrated associated circuitry, for initiating and turning-off current flow in the ignition coil 24 to cause spark firing at the proper time.

The ignition coil 24 has a primary winding 42 and a secondary winding 44. To initiate a flow of current in the primary winding 42, the transistor 40 is rendered conductive by a received spark command signal at terminal 37 so as to connect the primary winding 42 between a power source VPWR and ground. When the transistor 40 is turned off by the spark command signal, the magnetic field in the ignition coil collapses, thereby generating a rapidly increasing voltage in the secondary winding 44. When that voltage reaches the ionization point of the gap between the electrodes of the spark plug, the spark plug fires.

To measure the actual firing time of the spark plug, a current sensing resistor 46 is serially coupled between ground and the secondary winding 44. As the spark plug fires, a surge of current flows through the resistor 46, thereby providing a signal on lead 48 that signifies the actual firing of the spark plug. (The actual firing time of the spark plug may alternately be measured by detecting the collapse of the voltage across the secondary winding 44 which occurs in response to ionization of gas between the spark plug's electrodes.) That signal is coupled to the microprocessor 18 via the signal conditioning circuitry 34. The way in which the microprocessor responds to the signal on the lead 48 will now be described with reference to FIGS. 4, 5A and 5B.

Figure 4:
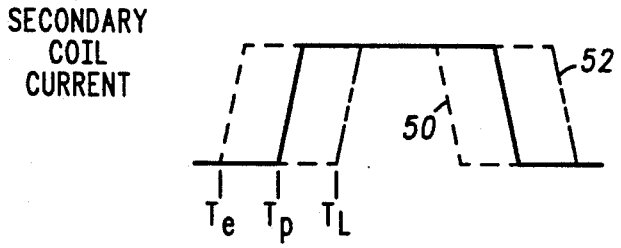
FIG. 4 is a waveform illustrating three possible conditions of current in the secondary winding of the ignition coil.

Referring first to FIG. 4, three waveforms are shown which illustrate current in the secondary winding 44 under three different conditions. Recalling that the current in the ignition coil's secondary winding begins when the spark plug fires, and assuming that $T_p$ designates the spark plug's planned or desired firing time, it can be seen that the current designated by the solid line represents proper firing of the spark plug. This current begins at time $T_p$, as desired. In contrast, the dashed line 50 represents the current through the secondary winding 44 which begins at time $T_e$ and results in the spark firing at a time which is too early. The dot—dash line 52 represents current in the secondary winding 44 which begins at time $T_L$ and which results in late firing of the spark plug. As will now be discussed with reference to FIGS. 5A and 5B, the microprocessor 18 is programmed to cause the turn-off time of the current in the primary winding 42 to be adjusted (advanced or retarded) so as to cause a proportional change in the turn-on time of the current in the secondary winding 44, thus reducing the difference between the actual firing time of the spark plug and its desired firing time. In other words, the curve 50 in FIG. 4 would be moved to the right so that the turn-on time of the current in the secondary winding is closer to or coincident with the time $T_p$, and the waveform 52 would be moved to the left to reduce or minimize any difference between the time $T_L$ and the time $T_p$.

Figure 5A:
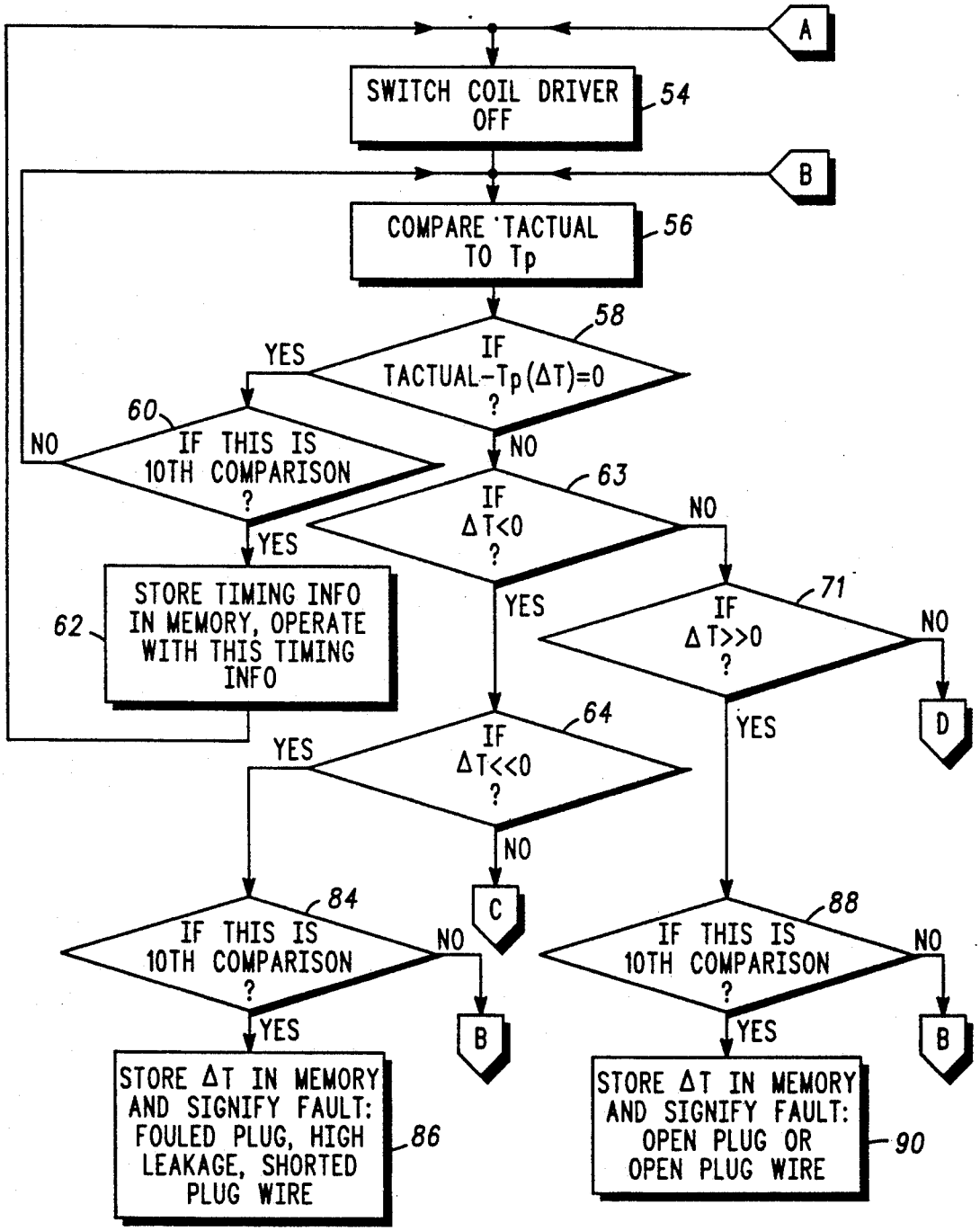
FIGS. 5A and 5B are flow charts which show how the invention is preferably implemented.
Figure 5B:
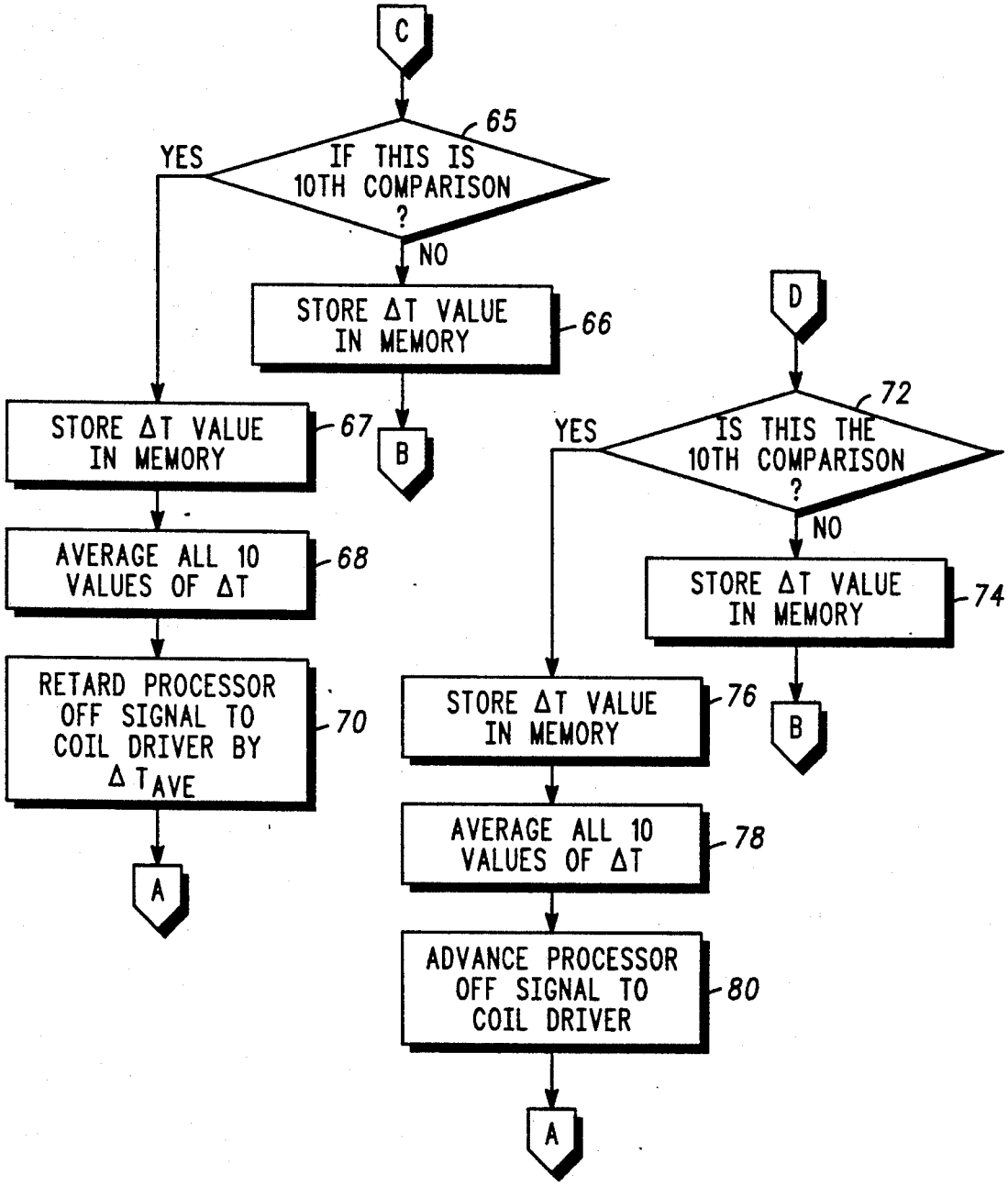

Turning now to FIG. 5A, the illustrative flowchart begins with an instruction 54 which causes the microprocessor to turn-off the coil driver 20. This causes the current in the primary winding of the ignition coil to terminate, thereby generating a collapsing magnetic field which results in a high voltage across the secondary winding 44 and, very shortly thereafter, firing of the spark plug 22. The resulting current which flows through the resistor 46 (FIG. 3) generates a signal on the lead 48 which is ultimately fed back to the microprocessor to indicate the actual firing time of the plug 22.

The next instruction 56 causes the microprocessor to compare the actual firing time of the spark plug (T actual) to the desired or planned firing time $T_p$. If T actual, the actual firing time, minus $T_p$ the planned firing time $T_p$, ($\Delta$ T) is equal to zero, this means that the spark plug is firing precisely at its desired or planned firing time, in which case the program proceeds to instruction 60. Per this instruction, the microprocessor determines whether this is the tenth consecutive comparison between the actual firing time and the planned firing time. If less than ten comparisons have occurred, the program continues back to the indicated point B in the program where it proceeds to loop through instructions 56, 58 and 60 until ten such comparisons have occurred.

If all ten comparisons result in $\Delta$ T being equal to zero, then the program proceeds to instruction 62 to store in a memory the timing information which the microprocessor has been using to generate the spark command signal and to continue to operate with that same timing information. Following instruction 62, the program proceeds to point A in the program where it again loops through the previously discussed instructions to insure that the timing information being used by the microprocessor continues to cause the actual firing time to be substantially equal to the planned firing time.

Referring back to instruction 58, if it was determined that $\Delta$ T was not equal to zero, then the program would proceed to instruction 63 to determine whether $\Delta$ T is less than zero. (A $\Delta$ T less than zero indicates that the firing time needs to be retarded, whereas a $\Delta$ T greater than zero indicates that the firing time needs to be advanced.) If the answer to that inquiry is yes, then the program proceeds to instruction 64 (which is related to diagnostics) to determine whether $\Delta$ T is much less than zero ("much less" means, for example, that the spark plug firing time, measured in degrees, is about four times less than is desired. Thus, in an engine having a desired firing time of 4° before TDC, an actual firing time of 12° after TDC would be mis-timed by 16°. Similarly, if the same engine has an actual firing time of 20° before TDC, an error of 16° would be present. These errors give rise to $\Delta$ T's that are either "much greater" or "much less" than zero. Of course, the amount of permitted error which is considered "too much" will depend on the engine and the amount of error which is tolerable.).

If execution of instruction 64 results in an answer of "no", the program proceeds to instruction 65 (FIG. 5B) to determine whether the most recent comparison between the actual firing time and the planned firing time is the tenth comparison. If it is not the tenth comparison, then the program proceeds to instruction 66 to store the value of $\Delta$ T in a memory location and then to proceed back to point B for looping through all the previous instructions until the result of instruction 65 indicates that ten comparisons have been made.

The program then proceeds to instruction 67 which causes the microprocessor to store the value of $\Delta$ T in a location in one of its memories. Then, per instruction 68, the microprocessor averages all ten of the most recent values of $\Delta$ T that were stored in memory to come up with an average value for $\Delta$ T, designated herein as $\Delta T_{ave}$.

Per the next instruction 70, the microprocessor adjusts its spark command signal so that the turn-off time of the current in the primary winding 42 is retarded by $\Delta T_{ave}$. This should result in the spark plug's firing time being adjusted so as to minimize the difference its actual firing time and its planned firing time. The program then proceeds back to point A for continuing to loop through the program and look for any new differences between actual firing time and the planned firing time.

It should be noted that once the actual firing time is made substantially coincident with the planned firing time, the microprocessor will continue to use the timing information which resulted in that improved firing time until changes in the system (such as a change in the gap in a spark plug) once again results in a measurable difference between the plug's actual firing time and its planned firing time.

Referring back again to instruction 63, if the execution of that instruction indicated that Δ T was greater than zero, then the program would have proceeded to instruction 71 (another diagnostic instruction) to determine whether Δ T is much greater than zero. If Δ T is not much greater than zero, the program proceeds to instruction 72 (FIG. 5B) to determine whether the most recent comparison was the tenth comparison. If the answer is no, instruction 74 causes the calculated value of Δ T to be stored in a location in the microprocessor's memory, whereupon the program proceeds back to point B for again looping through the program until ten consecutive comparisons have been made. If the execution of instruction 63 still results in a Δ T greater than zero (but not much greater than zero), then the execution of instruction 72 causes the program to proceed to instruction 76. The measured value of Δ T is stored in a memory location and the program proceeds to instruction 78 which causes the microprocessor to average the last ten measured values of Δ T to come up with an average Δ T ($\Delta T_{ave}$). Then, per instruction 80, the microprocessor advances the timing of its spark command signal to cause the current flowing in the primary winding of the ignition coil to turn-off earlier (by $\Delta T_{ave}$) and thereby cause the spark plug to fire at its planned firing time. Thereafter, the program proceeds back to point A to again begin the whole process again. Under normal circumstances however, when the actual firing time has been corrected to be substantially equal to the planned firing time, further corrections in the actual firing time will normally not be necessary on a short term basis.

If we now assume that the ignition system has a fault, the execution of instruction 64 (FIG. 5A) may have found that Δ T is much less than zero (indicative of a fouled plug, high leakage, or a shorted plug wire). In that event, the program proceeds to instruction 84 to determine whether ten comparisons have been made. If the answer is "yes", the system assumes that a fault condition exists, and instruction 86 causes the value of Δ T to be stored in memory for possible diagnostic use, and a fault condition is signified so as to alert the operator.

Likewise, if the execution of instruction 71 indicates that Δ T is much greater than zero (indicative of an open plug or an open plug wire) then instruction 88 determines whether ten comparisons have been made. If the answer is "yes", instruction 90 is executed to save the value of Δ T for diagnostic purposes and to alert the operator by signifying one of the fault conditions.

It can be seen from the foregoing discussion that the present technique is relatively inexpensive to implement from a hardware standpoint. However, it provides substantial advantages. It corrects for initial component tolerances and drift of components (e.g., change of spark gap or change in the characteristics of the ignition coil). Such correction results in proper ignition and combustion, and a reduction in undesirable exhaust emissions. Further, the built-in diagnostics can identify fault conditions at an early stage so that repairs can be made before the fault condition results in severely degraded operation.

It will be obvious to those skilled in the art that various alterations and modifications may be made without departing from the invention. Accordingly, it is intended that all such alterations and modifications be considered as within the spirit and scope of the invention as defined by the appended claims.

What is claimed is:

1. For an automotive ignition system having at least one spark plug having a desired firing time that occurs shortly after the turn-off of current in a primary winding of the ignition coil, a method for optimizing the actual firing time of the spark plug, comprising:

measuring N consecutive actual firing times of the spark plug;

calculating an average actual firing time based on the measured firing times;

comparing the average actual firing time to the desired firing time;

calculating an adjusted turn-off time for the current in the ignition coil's primary winding;

terminating current in the ignition coil's primary winding at the adjusted turn-off time until the average actual firing time again differs from the desired firing time; and signifying the existence of a fault condition in response to the existence of a large difference between the average actual firing time and the desired firing time.

2. For an automotive ignition system having an ignition coil with a secondary winding coupled to at least one spark plug that has a desired firing time, and wherein the spark plug fires shortly after the collapse of a magnetic field in the ignition coil, a method for optimizing the actual firing time of the spark plug, comprising:

sensing current in the ignition coil's secondary winding N times to measure N actual firing times of the spark plug;

calculating an average actual firing time based on the measured firing times;

comparing the average actual firing time to the desired firing time;

signifying a fault condition in response to the existence of a large difference between the average actual firing time and the desired firing time; and adjusting the time of collapse of the magnetic field in the ignition coil so as to reduce any difference between the average actual firing time and the desired firing time.

* * * * *